US005481949A

United States Patent [19]

Yen

[11] Patent Number: 5,481,949

[45] Date of Patent: Jan. 9, 1996

[54] LOCKING MEMBER FOR USE IN HAND TOOLS

[76] Inventor: En-Ji Yen, 18178 E. Wellington, Rowland Hts., Calif. 91748

[21] Appl. No.: 288,722

[22] Filed: Aug. 15, 1994

[51] Int. Cl.[6] ..... B25B 23/00

[52] U.S. Cl. ..... 81/438; 81/177.85; 279/24; 279/79; 403/327

[58] Field of Search ..... 81/125, 437–438, 81/177.85, 177.2, 439; 279/24, 29, 76, 79, 80; 403/327, 326; 24/563; 411/522

[56] References Cited

U.S. PATENT DOCUMENTS 2,805,594 9/1957 Fogel ..... 279/79 X 3,222,959 12/1965 Clark ..... 81/177.85 X 4,644,831 2/1987 Yang .

5,309,798 5/1994 Markwart et al. ..... 81/177.85 X

*Primary Examiner*—D. S. Meislin

*Attorney, Agent, or Firm*—Pollock, Vande Sande & Priddy

[57] ABSTRACT

A locking member including a sleeve and a U-shaped plate. The sleeve has an axial hole at one end thereof and its outer surface is provided with an annular groove having a pair of holes arranged face-to-face with each other. The U-shaped plate has clamp portions having protrusions which penetrate through the holes in the groove of the sleeve to project within the axial hole of the sleeve for temporarily clamping a rod object inserted into the sleeve.

5 Claims, 4 Drawing Sheets

LOCKING MEMBER FOR USE IN HAND TOOLS

FIELD OF THE INVENTION

The present invention relates generally to a locking member, and more particularly to a locking member which can clamp and grasp an element inserted into the hollow sleeve of a tool.

BACKGROUND OF THE INVENTION

The conventional locking member, as shown in FIG. 1, is widely applied in hand tools, particularly screwdrivers. FIG. 1 shows two typical examples of using the locking member in screwdrivers.

The first example is shown by A in FIG. 1 wherein the locking member is used for temporarily locking a detachable bit 3 within a first hollow sleeve 2 after the bit 3 is inserted into the first hollow sleeve 2 of the screwdriver. The second example is shown by B wherein the locking member temporarily retains a driver rod (such as first hollow sleeve 2 in the figure) of the tool within a handle 1 after the driver rod is inserted into the handle 1. The figure shows that the handle 1 has secured therein a second hollow sleeve 11 and a locking member provided at B for clamping the first hollow sleeve 2. If the diameter of the openings at both ends of the first hollow sleeve 2 are different, in addition to providing a locking member at A of the first end, another locking member is also provided at C of the second end. Generally speaking, the above-mentioned locking member is formed by fitting a spring member 21, such as the conventional C ring, into an annular groove in the inner surface of the first hollow sleeve 2 to clamp an element inserted into the first hollow sleeve 2. Another way of forming the locking member is to provide a ball in the hollow sleeve, the ball being pressed by a spring to project slightly from the inner surface of the hollow sleeve and clamp the rod object or the waist of the rod object inserted into the hollow sleeve as illustrated by B in FIG. 1. The allowed tolerance for this structure is generally 0.20 mm, but in the process of mass production, the distance the ball projects from the inner surface of the hollow sleeve will be greater than the allowed tolerance. As is well known to those skilled in the art, when the ball projects very slightly from the inner surface of the hollow sleeve, its locking function becomes insignificant; relatively, when the ball projects from the inner surface of the hollow sleeve too much, it will be difficult to insert the rod object into the hollow sleeve, and the ball will easily drop out. Another reason why it is hard to control the tolerance in this kind of structure is because when a hexagonal or quadrilateral steel bar is forged into a bit, the diameter of the steel bar will expand, and the expansion value is hard to control. In other words, the first reason is that the tolerance of the ball projecting from the inner surface of the hollow sleeve is difficult to control, and the second reason is that the diameter of the element such as a bit inserted into the hollow sleeve is hard to control. The second drawback may be eliminated by adopting centerless grinding for correction, but the cost of processing is very expensive.

In U.S. Pat. No. 4,644,831, Yang teaches an adaptor sleeve which includes a U-shaped spring clamp plate disposed in a second bore opening of the hollow sleeve for securing a bit inserted into the hollow sleeve. Yang's invention obviously differs from the conventional technique illustrated in FIG. 1 of the present invention in that the rod object cannot insert through any one of the openings of the hollow sleeve as in the conventional technique. Therefore, Yang's invention cannot be applied to the so-called four-in-one or six-in-one driver as shown in FIG. 1.

SUMMARY OF THE INVENTION

The primary object of the present invention is to provide an improved locking member for use in hand tools wherein a tool bit may be temporarily clamped within a driver rod of the tool.

Another object of the present invention is to provide an improved locking member for use in hand tools wherein the tool driver rod may be temporarily clamped within the tool handle.

To achieve the above-mentioned objects and other advantages, the present invention comprises a sleeve having an annular groove and an axial hole, the groove being provided with a pair of holes arranged face-to-face and which penetrate the groove into the interior of the sleeve, and a U-shaped spring plate the inner surface thereof being provided with a pair of protrusions arranged face-to-face, the U-shaped plate being inserted in the groove so that the protrusions extend through the pair of holes in said groove to project within the axial hole in the sleeve for clamping a rod object inserted into the sleeve. The present invention may be used in the handle of the hand tool to clamp the driver rod of the tool, or it may be used in the driver rod of the hand tool to clamp the bit, or it may be used in any other similar situations.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENTS

Figure 1:
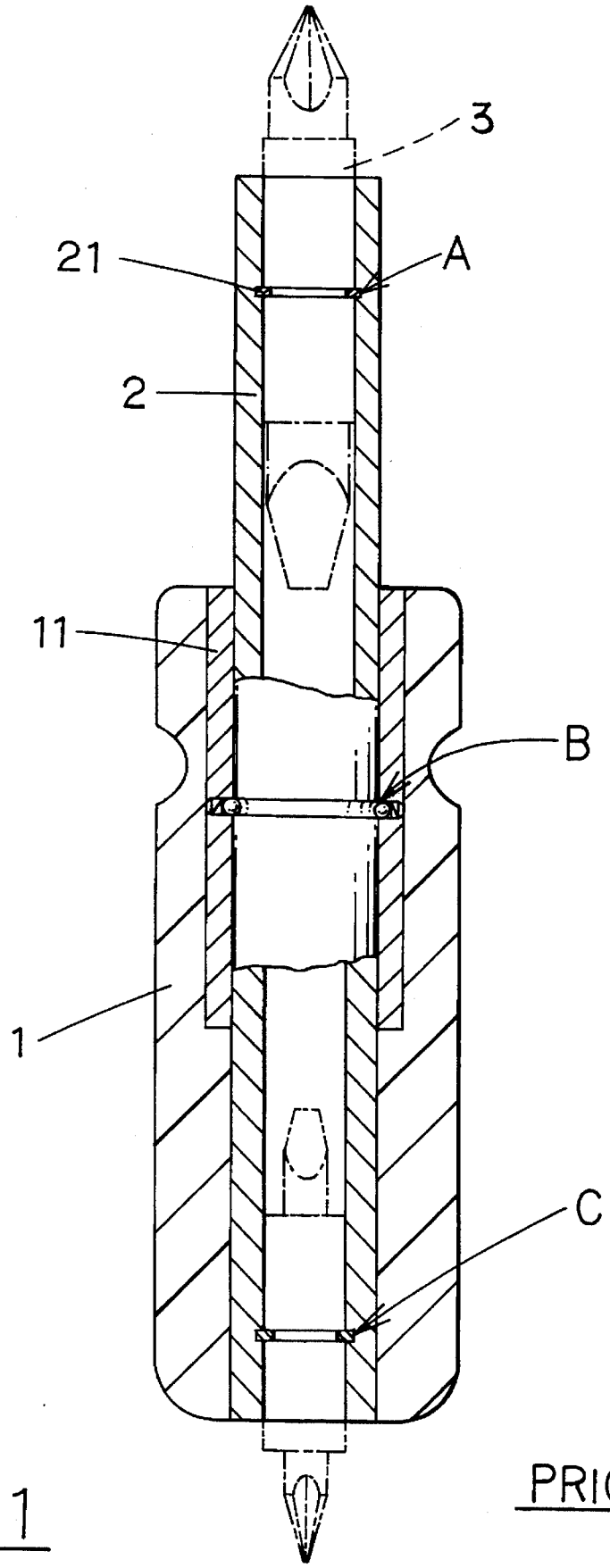
FIG. 1 PRIOR ART
FIG. 1 is a plane sectional view of the prior art, showing the usual positions of the locking member in the screwdriver.
Figure 2:
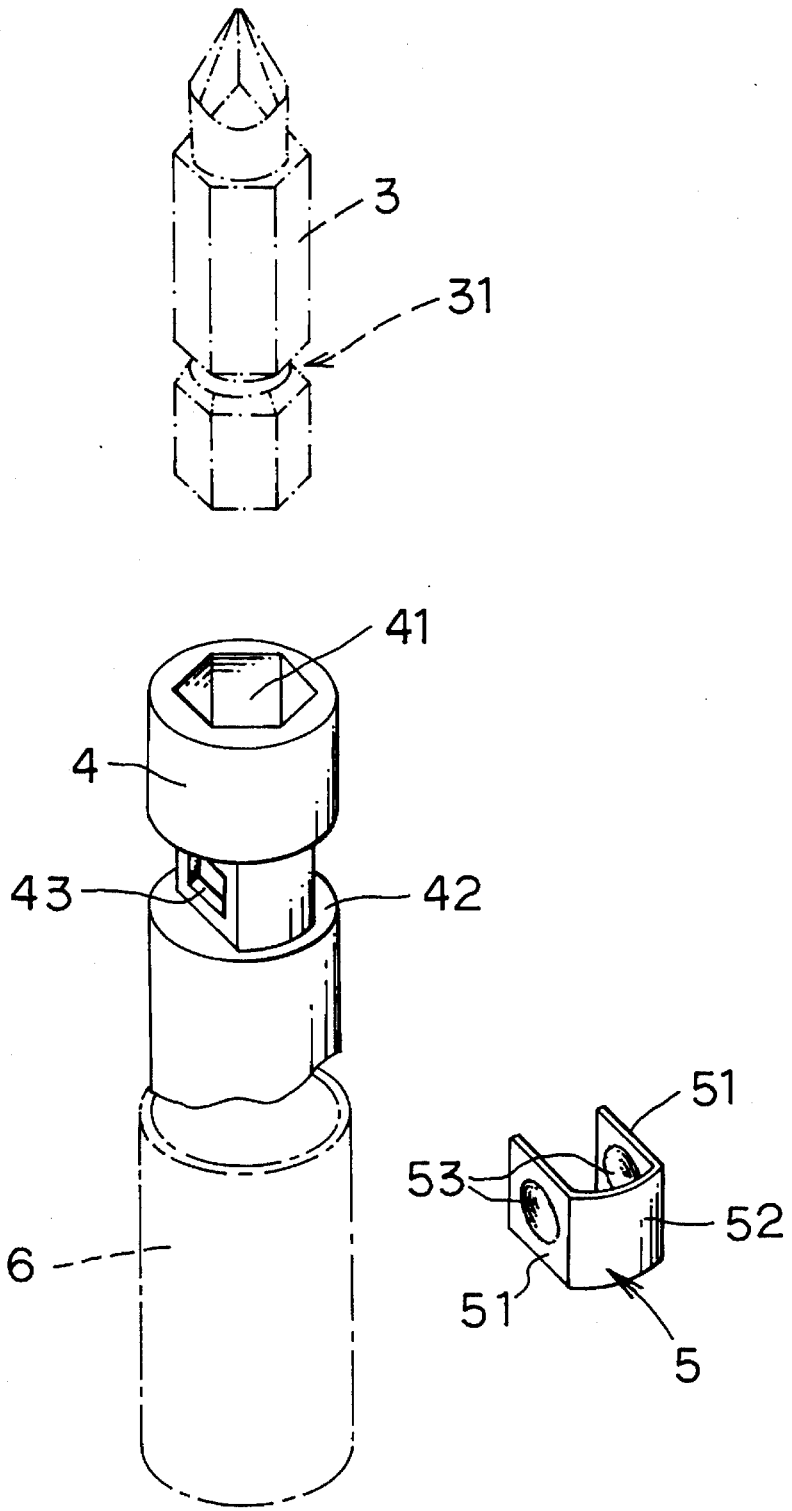
FIG. 2 is an exploded perspective view of a preferred embodiment of the present invention.
Figure 5:
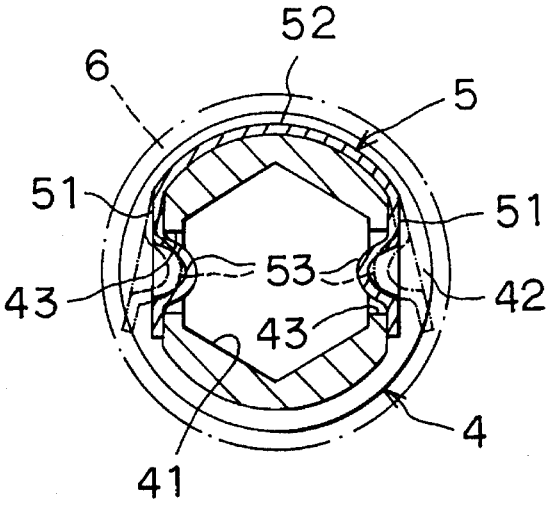
FIG. 5 is a sectional view taken along line 5–5 of FIG. 3.
Figure 4:
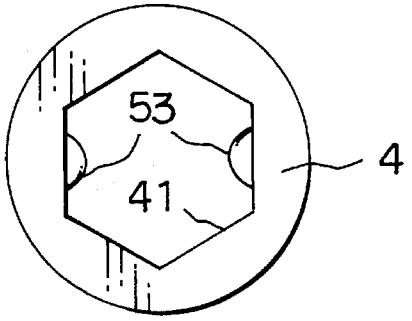
FIG. 4 is a top view of FIG. 3.
Figure 3:
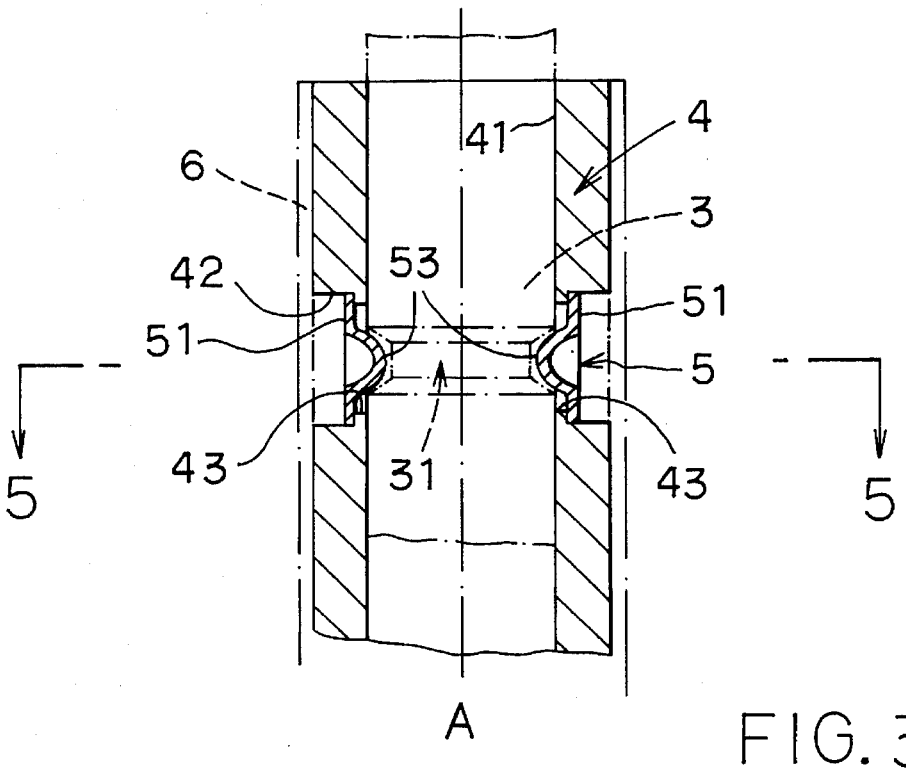
FIG. 3 is a partial sectional view of the preferred embodiment of the present invention, showing the locking member clamping a bit.

With reference to FIGS. 2 through 6, the locking member according to the present invention comprises a sleeve 4 having a groove 42 which is annular or any other form in the outer surface thereof, and an axial hole 41 having at least an axial opening, and the axial hole 41 may be quadrilateral, hexagonal or circular, for receiving a rod object to be clamped therein. An example of the rod object as shown in FIGS. 2 and 3 is a bit 3, and in FIG. 6, it is a driver rod 7 of a hand tool. In the groove 42 and perpendicular to the axis A of the sleeve 4 is provided two holes 43 arranged face-to-face with each other; these holes 43 extend from the groove 42 through to the axial hole 41.

The present invention further comprises a U-shaped spring plate 5 which has a pair of clamp portions 51 arranged face-to-face with each other and a link portion 52 extending from an end of the clamp portions 51. The inner surface of each clamp portion 51 is provided with a protrusion 53 which is smaller than the hole 43 in the groove 42, but the height of the protrusion 53 is greater than the distance from the outer surface of the groove 42 to the axial hole 41. When the U-shaped spring plate 5 is inserted into the groove 42, the two protrusions on the spring plate 5 may pass through the holes 43 in the groove 42 to protrude in the axial hole 41 of the sleeve 4 by means of the resilence of the spring plate 5. Any rod object inserted into the sleeve will be clamped by the protrusions 53 of the U-shaped spring plate 5 and locked within the sleeve 4. If desired, a jacket 6 may be added to the outer surface of the sleeve 4 to keep the spring plate 5 in place so that it may not slip out, but this is not necessary.

Figure 6:
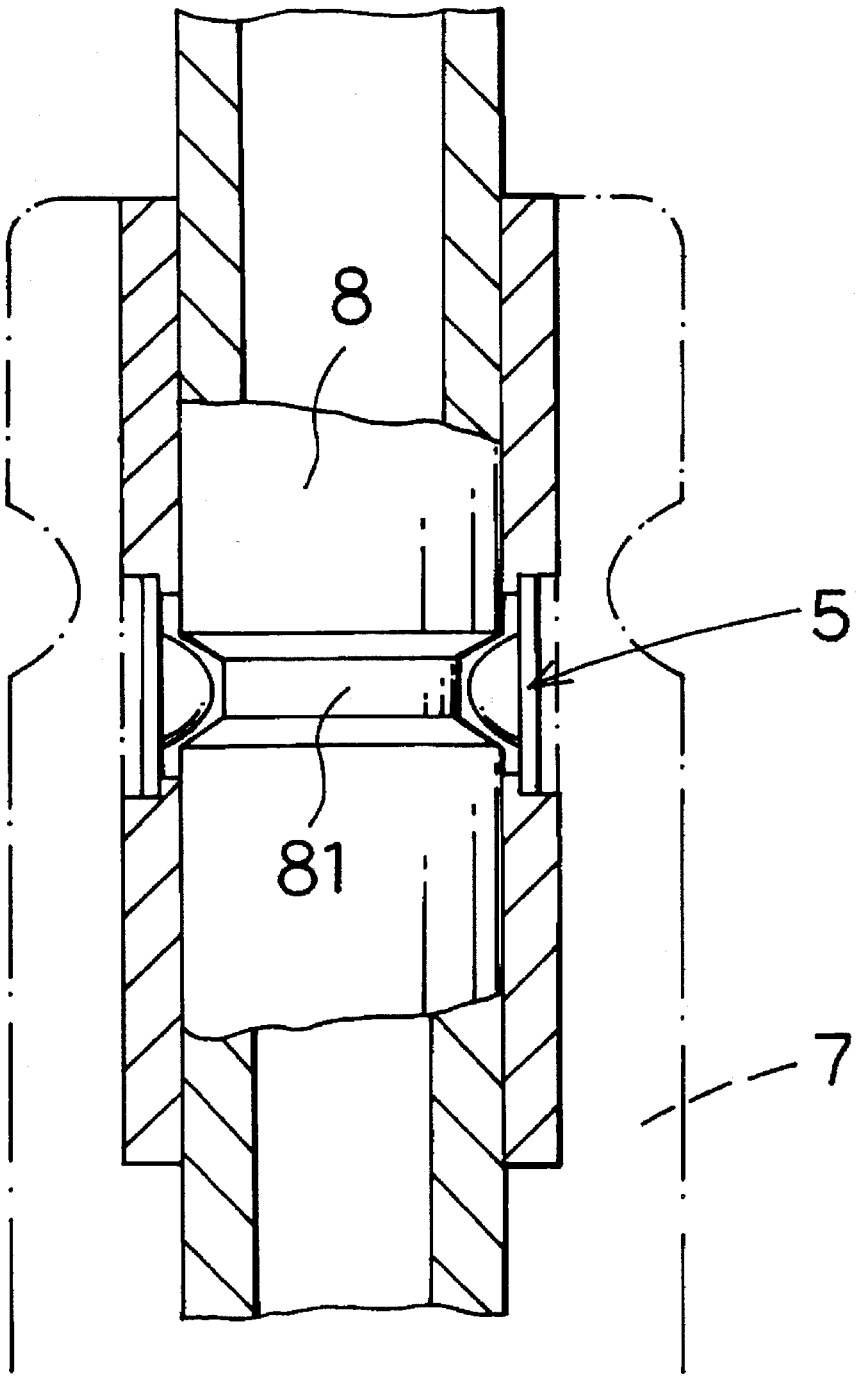
FIG. 6 is similar to FIG. 3, but showing the locking member applied in the handle for clamping a driver rod of a tool.

As mentioned above, the locking member may be used in a tool handle 7, as shown in FIG. 6, to clamp a driver rod 8 of the hand tool; or it may be used in clamping the bit 3 as shown by the embodiments in FIGS. 2 and 3 wherein the sleeve 4 of the locking member may be directly used as the driver rod of the tool. Obviously, the rod object to be clamped is provided with a waist portion 31 as in FIG. 2, or a waist portion 81 as in FIG. 6, the clamping effective will be enhanced. When the rod object is inserted into the axial hole 41 of the sleeve 4 and is in contact with the spring plate 5, the clamp portions 52 at both sides of the spring plate 5 will extend outwardly to grasp the rod object by means of the stress of the spring plate 5. It is obvious that the locking member according to the present invention may be used in other appropriate parts of the hand tool and should not be restricted to the positions shown in FIGS. 3 and 6.

Although the present invention has been illustrated and described with reference to the preferred embodiments thereof, it should be understood that it is in no way limited to the details of such embodiments, but is capable of numerous modifications within the scope of the appended claims.

What is claimed is:

1. A locking member for use in hand tools for temporarily locking a detachable rod object inserted into a sleeve, said locking member comprising:

said sleeve having at least one axial hole, and a groove provided in the outer surface of said sleeve, said groove being provided with a pair of holes arranged face-to-face with each other and in a direction perpendicular to the axis of said sleeve, said holes penetrating said groove into said axial hole of said sleeve;

a U-shaped spring plate having a pair of clamp portions arranged face-to-face with each other and a link portion extending from an end of each of the corresponding clamp portions; the inner surface of each of said clamp portions being provided with a protrusion which is smaller than each of said holes in said groove of said sleeve, wherein when said U-shaped spring plate is inserted into said groove, said protrusions extend through said holes in said groove to project within said sleeve for temporarily clamping a rod object inserted via said axial hole of said sleeve.

2. A locking member as claimed in claim 1, further comprising a jacket fitted onto the outer surface of said sleeve so that said U-shaped spring plate may not slip out of said groove.

3. A locking member as claimed in claim 1, wherein said sleeve is a driver rod of a hand tool and said rod object is a bit fitted at an end of said driver rod.

4. A locking member as claimed in claim 1, wherein said sleeve is secured within a handle of a hand tool.

5. A locking member as claimed in claim 4, wherein said rod object is a driver rod of a hand tool.

* * * * *